United States Patent [19]

Taguchi et al.

[11] 4,421,697

[45] Dec. 20, 1983

[54] METHOD AND APPARATUS FOR CASTING AN INNER LINING AMORPHOUS REFRACTORY INTO A MOLTEN METAL VESSEL

[75] Inventors: Kiyomi Taguchi; Osamu Terada; Noriaki Morishita; Hiroshi Mihashi, all of Fukuyama; Seiji Nagai, Hiroshima, all of Japan

[73] Assignee: Nippon Kokan Kabushiki Kaisha, Tokyo, Japan

[21] Appl. No.: 375,716

[22] Filed: May 7, 1982

[30] Foreign Application Priority Data

May 15, 1981 [JP] Japan ..... 56-72136

[51] Int. Cl.[3] ..... F27D 1/16

[52] U.S. Cl. ..... 264/30; 425/60; 425/425

[58] Field of Search ..... 264/30; 249/100; 425/60, 425

[56] References Cited

U.S. PATENT DOCUMENTS

| | | | |
|---|---|---|---|
| 3,779,679 | 12/1973 | Bisinella | 425/60 X |
| 3,856,453 | 12/1974 | Wells | 249/100 X |
| 4,101,622 | 7/1978 | Wells | 249/100 X |
| 4,214,856 | 7/1980 | Kolpakov | 425/60 |
| 4,218,050 | 8/1980 | Egli | 425/60 X |

*Primary Examiner*—Thomas P. Pavelko

*Attorney, Agent, or Firm*—Joseph W. Molasky

[57] ABSTRACT

There is disclosed the distribution of an amorphous refractory in a case where a lining frame is positioned within a molten metal vessel preliminarily lined with a permanent lining refractory and the amorphous refractory is cast into the space between the permanent lining refractory and the lining frame thereby applying a lining to the inner surface of the vessel.

A conical distributor is arranged above the lining frame and the amorphous refractory is continuously delivered from a rotary chute onto the distributor so as to describe a concentric path of moving falling points.

6 Claims, 2 Drawing Figures

METHOD AND APPARATUS FOR CASTING AN INNER LINING AMORPHOUS REFRACTORY INTO A MOLTEN METAL VESSEL

BACKGROUND OF THE INVENTION

The present invention relates to an improvement in an apparatus and method for distributing and casting a lining material onto the whole inner surface of a molten metal vessel during the application of an indeterminately shaped or amorphous refractory material to the inner surface of molten metal vessels.

In accordance with the invention, the term molten metal vessel means a vessel having a circular or elliptical cross-sectional shape such as a ladle or vacuum degassing vessel used in the making of steel.

Recently, a so-called cast lining method has been used for lining such a vessel with an amorphous refractory, in which a lining frame (or a core) is placed at a predetermined position within the vessel and an amorphous refractory is cast into the space between the lining frame and a permanent lining refractory previously installed in the vessel, thereby applying an inner lining to the vessel.

At the early stage, a lining method was developed comprising adding a small quantity, e.g., 5 to 7% of mixing water to an amorphous refractory, converting the same into a high-density slurry by vibration mixing, conveying the slurry as such to a large vessel and casting the slurry into the vessel while vibrating it thereby filling the vessel with the refractory. This method had the disadvantage of requiring several high-frequency vibrators with the accompanying necessity for noise suppressing measures and also requiring a variety of special large devices for providing the necessary vibrations during the transportation of the refractory, for vibrating the large vessel, etc., thus making the method unpractical.

Another casting method was designed so that a cylindrical lining frame (or a core) was arranged within a ladle placed on a suitable ground and a castable refractory having a water content of 7 to 8% was casted, while mixing by a mixer, through a trough directly into the space between the outer wall of the lining frame and the permanent lining refractory previously installed on the inner surface of the ladle. With this method, the falling place of the castable refractory was confined to the limited portion of the surrounding area of the ladle where the mixer was positioned, with the result that the refractory was piled in the limited portion and this piled refractory not only tended to move the frame under its pressure but also required the operation of levelling the piled refractory in the circumferential direction of the ladle by hand. Thus, there was the disadvantage of causing circumferential variations in the quality of the installed lining, thus causing an unbalanced melting loss during the use of the ladle and thereby reducing the service life of the ladle.

In an attempt to overcome the foregoing deficiencies, a method was devised in which a conical distributor was installed on the top of a ladle so that a castable refractory mixed by a mixer was distributed from the top of the distributor by means of a trough or belt conveyor to fall along the inclined surface of the conical distributor and simultaneously the ladle was vertically and laterally oscillated and/or rotated on an oscillatory rotating table, thereby casting the refractory. A disadvantage of this method was that while the distributor was conical in shape, the casting material was simply dropped from one place of the distributor top with the result that it was difficult to uniformly scatter the casting material in the circumferential direction of the ladle and therefore it was necessary to install a large equipment such as an oscillatory rotating table for oscillating and rotating the ladle which was as heavy as about 200 tons. Another disadvantage was that there was a limit to the mixer capacity (usually about 2 tons) and therefore it was necessary to perform the lining operation while intermittently repeating the mixing operation, thus making it impossible to effect a continuous casting operation and deteriorating the efficiency. Still other disadvantages were the occurence of dust in the vicinity of the mixer, the need to dispose the waste water due to the washing of the interior of the mixer and other defects from the operating environmental point of view.

To overcome these deficiencies, another method of continuously casting an amorphous refractory was devised, the method comprising mixing an amorphous refractory by a mixer located remote from a ladle, placing the refractory in an intermediate bucket, moving the intermediate bucket by a transfer crane to a position above a conical distributor arranged on the ladle and placing the bucket on the distributor and simultaneously opening the gate in the lower part of the intermediate bucket thereby causing the amorphous refractory to fall. This method was disadvantageous in that the conveyance of mixed refractory from the mixer to the ladle had to be repeated frequently making the use of this method impossible in cases where the operating rate of the existing cranes had nothing in reserve and also there was the need to provide additional conveyance equipment for conveying the bucket exclusively.

On the other hand, an apparatus was proposed in which with a main object of distributing a refractory material along the entire inner surface of a ladle uniformly, a rotary chute was arranged below the forward end of a belt conveyor for conveying the mixed refractory from a mixer and the rotary chute discharge end was rotated along the gap surrounding a lining frame within the ladle. This apparatus was disadvantageous in that the apparatus was not only complicated and large in mechanical construction but also the rotation of the rotary chute just above the ladle presented a problem from the standpoint of safety to operators in cases where any operation had to be performed inside or on the ladle.

As described hereinabove, the prior art lining apparatus and methods are all disadvantageous in that the lining material cannot be distributed uniformly within a ladle and the lining life is short, that much labor is required, that the continuous operation is not easy, that much funds are required for the necessary equipment, that there are difficulties from the environmental and safety points of view and so on.

SUMMARY OF THE INVENTION

With a view to overcoming the foregoing deficiencies in the prior art, it is the primary object of the present invention to provide a lining apparatus and method capable of automatically and continuously casting a refractory material over the entire inner surface of a vessel uniformly and also effecting the lining in accordance with the size of vessels by means of a simple construction.

To accomplish the above and other objects, a lining method according to the invention features that where a lining frame is positioned within a molten metal vessel lined preliminarily with a permanent lining refractory and an amorphous refractory is cast into the space between the permanent lining refractory and the lining frame to effect the lining, a chute is rotated above a conical distributor such that the amorphous refractory is continuously cast from the chute to fall onto the distributor and the amorphous refractory is dropped from the outer periphery of the distributor into the space.

A lining apparatus according to the invention features that it comprises a conical distributor arranged above a lining frame positioned within a molten metal vessel thereby distributing a stream of amorphous refractory to drop from the outer periphery of the distributor into the space between the permanent lining refractory of the vessel and the lining frame, and a chute adapted to be rotated so as to continuously cast the amorphous refractory onto the conical inclined surface of the distributor while rotating above the latter.

The conical inclined surface of the distributor has an angle of inclination preferably in the range of 45° to 50°, and some frusto-conical coupling adapters of greater diameters may be suitably fitted to the lower part of the conical distributor for accommodating differences in the size (inner diameter) of vessels. In this case, the adapters must be superimposed one upon another so that the outer periphery of the upper one is overlapped on the conical inclined surface of the lower one thereby preventing any gap between the conical distributor and the frusto-conical adapter and between the adapters.

It is important that the top of the lining frame does not directly contact with the conical distributor or the lowermost adapter if the adapters are fitted and for this purpose a gap or vibration damping members are provided between the two. This is for the purpose of preventing the distributor or the adaptors from being vibrated by the vibrations of the lining frame and this has the effect of preventing the amorphous refractory falling over the conical inclined surface from being applied nonuniformly due to the vibrations.

Thus, in accordance with the invention, due to the fact that the amorphous refractory cast from the forward end of the rotary chute continuously drops onto the conical distributor so as to describe a path of moving falling points which is concentric with the distributor and also the amorphous refractory is distributed such that the amorphous refractory falls along the conical inclined surface of the distributor and drops from the outer periphery of the conical inclined surface into the space in the vessel around the lining frame along the entire periphery, thereby lining the inner surface of the vessel with the amorphous refractory cast and piled in a uniform amount along the entire periphery at all times.

The above and other objects and effects of the present invention will become more apparent from the following detailed description taken in conjunction with the accompanying drawings.

DESCRIPTION OF THE PREFERRED EMBODIMENTS

Figure 1:
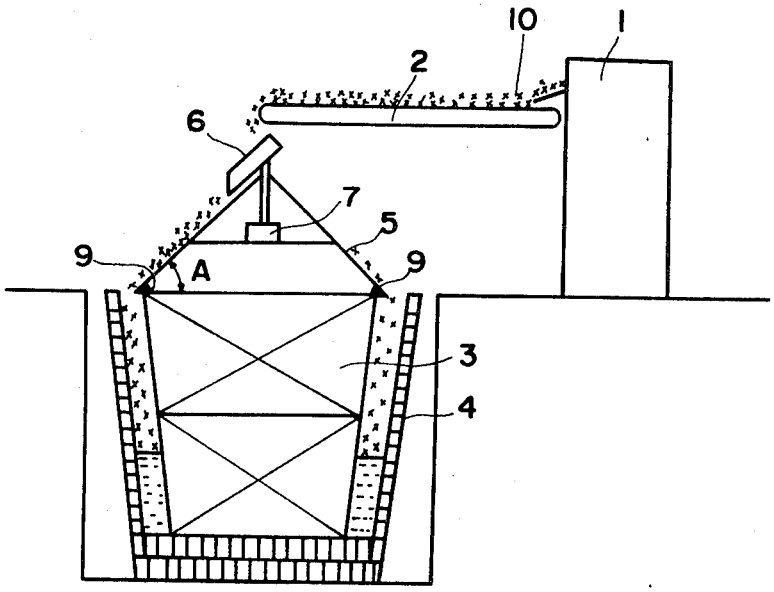
FIG. 1 is a sectional view showing schematically the construction of an apparatus according to an embodiment of the invention.

Referring to FIG. 1, numeral 1 designates a mixer for mixing a castable refractory, which is provided with a hopper (not shown) for storing a mixed casting material so as to continuously supply the necessary refractory material for the lining. A mixed castable refractory 10 is discharged onto a belt conveyor 2 by way of a gate (not shown) provided at the exit of the hopper. The belt driving speed of the belt conveyor 2 is adjusted by a speed change gear or the like so as to satisfy the required casting rate per unit time. A cylindrical lining frame 3 is positioned inside a ladle 4 so as to define a predetermined space along the entire inner surface of the ladle 4. Disposed above the lining frame 3 is a conical (helmet) distributor 5 which covers the entire circular upper surface of the lining frame 3.

The lining frame 3 and the conical distributor 5 may be provided as a single unit or they may be provided as separate units. What is important with the distributor 5 is angle A formed by the inclined surface and the horizontal base of the conical shape. If the angle A is too small, the flow of the castable refractory 10 is deteriorated and the refractory 10 is retained on the inclined surface, thereby making it necessary to interrupt the operation and scrape off the refractory 10 manually. If the angle A is too large so that the inclined surface becomes steep, the falling castable refractory 10 is scattered to the outside of the ladle 4 and wasted, thus causing the unit of the castable refractory to increase.

Then, disposed at the top of the distributor 5 is a rotary chute 6 having about the same inclination as the angle of inclination of the distributor 5. The rotary chute 7 is driven by a driving unit 7 located inside the conical distributor 5 so as to rotate at a given speed through 360 degrees around the entire periphery of the inclined surface of the conical distributor 5. The rotational speed of the rotary chute 6 is determined in accordance with the type of refractory material to be cast and the roughness and fineness of the distributing method and the speed is selected for example in the range of 9 to 15 revolutions per minute.

Since the flow characteristic of an amorphous refractory to be cast varies depending on the raw materials used, particle sizes, blending composition, mixing water content, etc., tests were conducted on many different types of castable refractories for the purpose of determining the angle of inclination of the conical distributor 5. As a result, it was found that the inclination angle A must be more than 45 degrees. It was also confirmed that the angles greater than 50 degrees are not desirable since an increased proportion of the refractory is scattered to the outside of the vessel.

Generally, there are molten metal vessels of many different shapes and types and there are also many cases where cylindrical vessels of different diameters such as ladles are used during a single operation. As a result, where vessels are to be lined at the same place, it is necessary to manufacture and prepare conical distributors 5 of different diameters and this presents difficulties from the standpoint of equipment cost and a space which must be secured for storage of the distributors.

Figure 2:
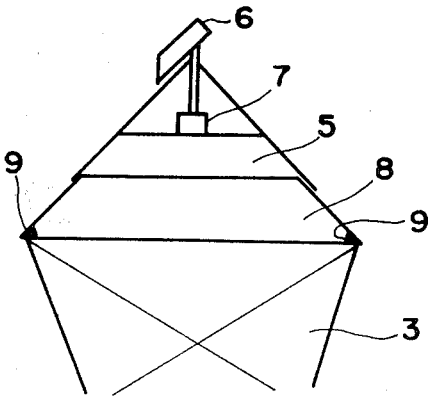
FIG. 2 is a sectional view showing schematically the construction of an apparatus according to another embodiment of the invention.

In accordance with the present invention, these difficulties are solved by the embodiment of FIG. 2 in which a combination frusto-conical adapter 8 corresponding to the greater top diameter of the ladle 4 is first set on the lining frame 3 and the ladle conical distributor 5 of the smaller diameter is placed on the top of the adapter 8. In this case, the distributor 5 and the combination frusto-conical adapter 8 have the same angle of inclination and the upper part or about 20 to 30 cm of the combination frusto-conical adapter 8 is overlapped by the lower part of the distributor 5 so as to prevent any leakage of the falling refractory at the joint of the two. In this case, since the whole distributor 5 is raised and the refractory inlet port of the rotary chute 6 is also moved upwards, it is desirable to construct the belt conveyor 2 such that it is allowed to move back and forth in the lengthwise direction and make an oscillatory motion vertically and laterally to adjust the position of its discharging port.

Generally, there are cases where a vibrator will be operated in the refractory material or the lining frame will be vibrated so as to increase the loading density of the cast refractory. In such a case, irrespective of whether the lining frame 3 and the conical distributor 5 are in the form of a single unit or separate units, if the vibrations of the lining frame 3 are transmitted to the conical distributor 5, the refractory falling along the inclined surface of the conical distributor 5 will adhere to and accumulate on the inclined surface under the effect of the vibrations and the operation of scraping off the refractory with a shovel or the like will be required. Thus, it is necessary to prevent the lining frame 3 and the conical distributor 5 from contacting with each other directly.

In accordance with the present invention, as a vibration damping measure to prevent the vibrations of the lining frame 3 from being transmitted to the conical distributor 5, vibration damping elastic members 9 comprising for example rubber members or springs are provided at circumferential positions where the lining frame 3 is in contact with the frusto-conical adapter 8 or the conical distributor 5 as shown in FIGS. 1 and 2, thereby absorbing the vibrations. Of course, the distributor 5 or the adapter 8 may be arranged apart from the lining frame 3.

With the construction described above, in accordance with the apparatus of this invention the casting castable refractory supplied in a predetermined amount from the belt conveyor 2 is distributed uniformly onto the entire inclined surface of the conical distributor 5 by the rotary chute 6 rotating at a predetermined speed and thus the refractory material is supplied uniformly and continuously along the entire inner surface of the ladle 4. As a result, there is no danger of the lining frame 3 being shifted by the non-uniformly distributed refractory and also there is no need to effect the operation of levelling off the refractory manually. Thus, there is no circumferential variation in the quality of the refractory and the melting loss of the refractory also proceeds uniformly, thereby increasing the service life of the lining.

Further, by limiting the angle of inclination of the conical distributor 5 and providing the vibration damping means, there is no danger of the refractory depositing on the distributor 5 and the operating efficiency is improved. Still further, by combining the distributors of the two shapes, e.g., the conical and frusto-conical shapes together, ladles of different diameters can be lined successively at the same place with the simple apparatus.

Still further, the present invention can be carried out without vibrating large vessels or using any device for oscillating and rotating the vessels and without the need to install for example a crane for conveying a casting material. Thus, the desired satisfactory lining of vessels can be accomplished automatically and continuously in a safe manner with the simple apparatus.

The operation of lining a ladle in accordance with the apparatus of this invention will now be described. A ladle is first placed in a pit in the manner as shown in FIG. 1 for ladle repairing purposes. If necessary, the brickwork at the ladle bottom is repaired first and then the lining frame 3 is set on the brickwork centrally in the ladle. The lining frame 3 is prepared to have the desired diameter and height to provide the desired lining thickness and height. Then, the conical distributor 5 is placed on the lining frame 3. Note that where the lining of a large-diameter vessel is effected, as shown in FIG. 2, the combination frusto-conical adapter 8 is first set in place and then the conical distributor 5 is fitted on the former. Then the forward end position of the belt conveyor 2 is adjusted such that the outlet of the belt conveyor 2 is aligned with the inlet of the rotary chute 6, thus completing the preparations for the lining operation.

The maximum lining capacity will be about 24 t/h on the basis of the mixer 1 if it has for example the refractory material charging time of 2 minutes, mixing time of 2 minutes, discharging time of 1 minute and mixer capacity of 2 t/batch, and the lining method of this invention performs a continuous casting. Thus, the mixer 1 is provided with a storage tank (not shown) so that the mixed refractory for one batch is stored for a short period of time and in this way the supply of refractory during the material charging operation of the mixer 1 is prevented from being interrupted.

The refractory on the belt conveyor 2 is loaded through the predetermined gate and thus the loaded quantity is substantially constant. However, where the casting rate per unit time must be adjusted, it can be changed as desired by means of the change gear motor for the driving unit of the belt conveyor 2.

The rotational speed of the rotary chute 6 is determined in dependence on the number of revolutions required for casting the refractory material supplied at the predetermined flow rate per unit time.

In other words, the rotational speed of the rotary chute 6 is determined in dependence on the operating requirements, such as, the type, blending water content and lining requirements of the castable refractory and on whether the lining is effected by piling the refractory in small amounts or by casting a large amount of the refractory per revolution. When the casting operation is completed, the refractory is cured as such for about 3 hours and then it is heated at a given rate of temperature rise with the maximum temperature of 1,200° C. (the refractory surface temperature) for a total of 45 to 60 hours, thereby commencing the receipt of molten metal.

Next, an example of the lining operation performed 15 times on the actual ladles in an iron work in accordance with the apparatus and method of this invention will be described in comparison with the prior art method. The following Table 1 is a comparison table showing the refractories, equipment and lining methods use in performing the present invention and the prior art method, and the following Table 2 is a comparison table showing the surface hardness, porosities and service lives of the refractories lined by the two methods.

TABLE 1

| Refractory, Apparatus and Lining Method | | | |
|---|---|---|---|
| Type of refractory | | Invention method Pyrophillite-zircon | Prior art method Pyrophillite-zircon |
| Refractory composition | $SiO_2$ | 57.0% | 44.0% |
| | $Al_2O_3$ | 6.4% | 10.0% |
| | $ZrO_2$ | 33.3% | 44.0% |
| Ladle capacity | | 180 t | 180 t |
| Mixer capacity | | 2 t/batch | 2 t/batch |
| Vibration method | | Frame vibration | Frame vibration |
| Mixing conditions | water content | 5.5–6.0% | 6.0–6.5% |
| | time | 2 minutes | 2 minutes |
| Refractory transport method | | Belt conveyor | Tilted trough |
| Rotary chute | | | None |
| motor | | 0.4 Kw | Refractory is cast |
| rotational speed | | 11.7 RPM | from one position on |
| length | | 1,000 mm | frame periphery and |
| angle | | 50 degrees | levelled off manually |
| Distributor angle | | 50 degrees | None |
| Vibration damping | | Rubber at 8 positions | None |
| Lining time | | 1.5 hours | 2.0 hours |
| Cast quantity | | 20 t | 20 t |
| Ladle drying time | | 4.5 hours | 5,0 hours |

TABLE 2

| Lining Results | | | | |
|---|---|---|---|---|
| | Surface hardness Hs after lining | | | |
| | Invention method | | Prior art method | |
| | Mixer side | Opposite side | Mixer side | Opposite side |
| 3.5 m | 90 | 90 | 75 | 80 |
| 3.0 | 90 | 85 | 79 | 80 |
| 2.0 | 82 | 85 | 75 | 80 |
| 1.0 | 88 | 90 | 63 | 78 |
| 0.5 | 88 | 87 | 80 | 85 |
| Apparent porosities (%) | 18.2 | 18.3 | 22.2 | 19.3 |
| Ladle service life | times/ladle | | | |
| Average number of times | 52.5 | | 43.5 | |
| Minimum-Maximum | 49–58 | | 35–53 | |
| Number of ladles lined | 15 | | 20 | |

Note 1.
Measuring method of surface hardness. After the cure of the lining, the surface hardness of each ladle at each of predetermined heights was measured by a Shore hardness tester and the average values of the ladles were obtained.
Note 2.
Measuring method of apparent porosity. After the curing, the apparent porosities of the ladles were measured by random sampling in accordance with JIS R2205 and the average values were obtained.
Note 3.
The service lives represent the number of times the ladles were used before the renewal of the linings on the side walls.

As will be seen from the above Tables 1 and 2, in accordance with the lining apparatus and method of this invention the linings installed were not only excellent in quality as compared with the prior art apparatus and method in that the variations in surface hardness and apparent porosity according to the heights of the linings were reduced and excellent, but also the average life of the ladles was increased by about 20% and the longer lives with reduced variations and high stability were ensured.

Further, in accordance with the invention the continuous operation was made possible and the lining time (the required casting time) was reduced from the previous time of 2 hours to 1.5 hours, with the resulting reduction in the required man-hours.

It should be apparent to those skilled in the art that the lining apparatus and method can be applied to molten metal vessels other than ladles, particularly those having circular or elliptical cross-sectional shapes.

What is claimed is:

1. A lining method wherein when a lining frame is positioned within a molten metal vessel preliminarily lined with a permanent lining refractory and an amorphous refractory is casted into a space between said permanent lining refractory and said lining frame to thereby apply a lining to said vessel, while rotating a chute above a conical distributor, said amorphous refractory is caused to continuously fall down onto said distributor so as to describe a concentric path of moving falling points, and said amorphous refractory is dropped over a conical inclined surface of said distributor to fall into said space from an outer periphery of said distributor.

2. An apparatus of the type in which a lining frame is positioned within a molten metal vessel preliminarily lined with a permanent lining refractory and an amorphous refractory is casted into a space between said permanent lining refractory and said lining frame thereby applying a lining to said vessel, said apparatus comprising:

a conical distributor arranged above said lining frame for distributing a stream of said amorphous refractory to fall down from the outer periphery thereof into said space; and a chute rotatable to cause said amorphous refractory to fall down onto a conical inclined surface of said distributor such that falling points of said amorphous refractory describe a circular path of movement concentric with said conical shape of said distributor.

3. An apparatus according to claim 2, wherein the angle of inclination of the inclined surface of said conical distributor is in a range between 45° and 50° with respect to the horizontal plane.

4. An apparatus according to claim 2, wherein vibration damping means is attached to a lower part of said conical distributor to prevent the transmission of vibrations from said lining frame to said conical distributor.

5. An apparatus according to claim 2, wherein a frusto-conical adapter greater in diameter and about the same in angle of inclination to said conical distributor is fitted in the lower part of said conical distributor, whereby said distributor and said adapter form a greater conical shape.

6. An apparatus according to claim 5, wherein vibration damping means is attached to a lower part of said frusto-conical adapter to prevent the transmission of vibrations from said lining frame to said adapter.

* * * * *